US009280095B2

(12) United States Patent
Hayashi

(10) Patent No.: US 9,280,095 B2
(45) Date of Patent: Mar. 8, 2016

(54) DEVELOPING DEVICE AND IMAGE FORMING APPARATUS HAVING SEAL MEMBER WITH NON-CONTACT PORTION

(71) Applicant: Konica Minolta, Inc., Chiyoda-ku (JP)

(72) Inventor: Hideji Hayashi, Okazaki (JP)

(73) Assignee: KONICA MINOLTA, INC., Chiyoda-Ku, Tokyo (JP)

( * ) Notice: Subject to any disclaimer, the term of this patent is extended or adjusted under 35 U.S.C. 154(b) by 0 days.

(21) Appl. No.: 14/475,078

(22) Filed: Sep. 2, 2014

(65) Prior Publication Data

US 2015/0063862 A1 Mar. 5, 2015

(30) Foreign Application Priority Data

Sep. 2, 2013 (JP) ..... 2013-181069

(51) Int. Cl.
*G03G 15/08* (2006.01)
*G03G 15/09* (2006.01)

(52) U.S. Cl.
CPC ..... *G03G 15/0942* (2013.01); *G03G 15/0817* (2013.01)

(58) Field of Classification Search
CPC ..... G03G 15/0813; G03G 15/0817; G03G 15/0942
USPC ..... 399/103
See application file for complete search history.

(56) References Cited

U.S. PATENT DOCUMENTS 4,616,919 A * 10/1986 Adley et al. ..... 399/103
4,800,411 A * 1/1989 Tanaka et al. ..... 399/103
4,897,693 A * 1/1990 Sawayama ..... 399/104
5,293,199 A * 3/1994 Saito et al. ..... 399/103
5,321,473 A * 6/1994 Azami ..... 399/103
6,356,735 B1 * 3/2002 Hozumi ..... 399/395
7,697,864 B2 * 4/2010 Inaba et al. ..... 399/103
2009/0067877 A1 3/2009 Terai

FOREIGN PATENT DOCUMENTS

JP 2007-232815 A 9/2007
JP 2009-058944 A 3/2009

OTHER PUBLICATIONS

Notification of Reasons for Refusal issued in corresponding Japanese Patent Application No. 2013-181069; mailed Sep. 1, 2015, with English Translation (6 pages).

* cited by examiner

*Primary Examiner* — Billy Lactaoen
*Assistant Examiner* — Arlene Heredia Ocasio
(74) *Attorney, Agent, or Firm* — Buchanan Ingersoll & Rooney PC

(57) ABSTRACT

A developing device forms an image by developing an electrostatic latent image on a photoreceptor rotating about a rotation axis. The developing device includes a housing having an opening opposite the photoreceptor, a developing sleeve disposed inside the housing, a magnetic body disposed in a central portion of the developing sleeve and not in no-magnet portions thereof at both sides of the central portion, and seal members supported by the housing. Each of the seal members shields either one of portions of the photoreceptor that are located opposite the no-magnet portions and is in surface contact with either one of end portions of the photoreceptor farther from a center of the photoreceptor than the no-magnet portions. Each of the seal members includes, at an end thereof closer to the center of the photoreceptor than the other end thereof, a non-contact portion that is not in contact with the photoreceptor.

14 Claims, 10 Drawing Sheets

DEVELOPING DEVICE AND IMAGE FORMING APPARATUS HAVING SEAL MEMBER WITH NON-CONTACT PORTION

CROSS-REFERENCE TO RELATED APPLICATIONS

This application is based on an application No. 2013-181069 filed in Japan, the contents of which are hereby incorporated by reference.

BACKGROUND OF THE INVENTION (1) Field of the Invention

The present invention relates to a developing device that develops an electrostatic latent image formed on a photoreceptor, and to an image forming apparatus including the developing device.

(2) Description of the Related Art

An image forming apparatus that employs electrophotographic method is generally provided with a developing device that develops, using toner, an electrostatic latent image formed on a photoreceptor drum. The toner image formed on the photoreceptor drum by the developing device is transferred to, and subsequently thermally fixed on a recording sheet.

The developing device includes a cylindrical developing sleeve located opposite and in parallel with the photoreceptor drum, and a cylindrical magnetic body fitted in the developing sleeve so as to be coaxial. The magnetic body is fixed so as not to rotate. The magnetic body is provided with magnetic poles at a plurality of positions along the circumferential direction thereof. The magnetic poles each extend along an axial direction (i.e., a direction along the axis). The developing sleeve rotates about the magnetic body in a predetermined direction.

With respect to the above-mentioned developing device, the developing sleeve rotates to transport magnetic toner stored in the developing device to a position opposite the photoreceptor drum, where the electrostatic latent image on the photoreceptor drum is developed with the toner. In this way, a toner image is formed on the photoreceptor drum.

Each end portion of the developing sleeve in the axial direction is a portion in which the magnetic body does not exist (hereinafter, referred to as a "no-magnet portion"). Toner is not transported to the no-magnet portions of the developing sleeve. Accordingly, toner image is not formed on portions of the photoreceptor drum which are opposite the no-magnet portions. Note that toner image is not formed on a portion on each end portion of the photoreceptor drum. Hereinafter, the portion is referred to as a "non-image-formation portion".

Some image forming apparatuses of this type are constituted to allow for transferring a maximum-size toner image formed on the photoreceptor drum onto a recording sheet having a size larger than the maximum size, so as to form an image on the recording sheet without a margin.

For example, when the maximum-size a toner image formed on the photoreceptor drum by the developing device is A3 size, the toner image on the photoreceptor drum is transferred to and fixed onto a recording sheet having a size larger than A3 size. The size larger than A3 size is generally referred to as "enlarged A3 size".

Marks indicating the positions of the corners of a recording sheet of A3 size are formed using toner on the photoreceptor drum simultaneously with a toner image of A3 size. These marks are generally referred to as "printer's marks". The toner image formed on the photoreceptor drum is transferred to and fixed on a recording sheet of enlarged A3 size with a margin formed along the periphery of the recording sheet.

The recording sheet of enlarged A3 size on which a toner image has been fixed is cut according to the "printer's marks". Thus, the peripheral margin of the recording sheet is removed, and the size of the recording sheet is reduced to a predetermined size (i.e., A3 size). Note that, hereinafter, the printing of a predetermined size on which a toner image is formed without margin along the periphery of the recording sheet as described above is referred to as a "marginless printing".

As described above, when a toner image of A3 size is formed on the photoreceptor drum, toner may be transported on a portion of the developing sleeve that borders the no-magnet portion. The magnetic body does not exist in the no-magnet portion. Therefore, smaller amount of magnetic force acts on the toner on the boundary portion adjacent to the no-magnet portion of the developing sleeve. Consequently, there is a risk that a portion of the toner on the boundary portion under the effect of the centrifugal force generated by the rotation of the developing sleeve is scattered to the no-magnet portion on which magnetic force does not act, and sticks to the non-image-formation portion of the photoreceptor drum.

The toner sticking to the non-image-formation portion is not transferred to a recording sheet of A3 size, but may be transferred to the peripheral margin of a recording sheet of enlarged A3 size. The peripheral margin of a recording sheet of enlarged A3 size having a toner image formed thereon is cut off after the recording sheet is printed out, and a "marginless printing" of A3 size is obtained. However, if a user happens to see the toner sticking to the margin of the recording sheet before the margin is cut off, the user may have a concern that some problem has occurred in the image forming apparatus. Therefore, it is preferable that toner is prevented from sticking to the margin of a recording sheet of enlarged A3 size.

A developing device generally includes seal members so as to prevent leakage of toner to the outside of the developing device from the ends of a developing sleeve in the axial direction thereof. Each of the seal members is pressed against, and in surface contact with, either one of end portions of a photoreceptor drum. Some proposals have been made to prevent toner from sticking to the non-image-formation portion of the photoreceptor drum by using the seal member as described above.

According to these proposals, each of the seal members is pressed against either one of end portions of a photoreceptor drum, and shields a non-image-formation portion of the photoreceptor drum from toner. The non-image-formation portion is the portion that faces the no-magnet portion of the developing sleeve. One of end surfaces of each of the seal members that is on the inner side of the developing device (i.e., closer to the center of the developing sleeve in the axial direction) is located in the vicinity of either one of the ends of the magnetic body in the axial direction, and is in contact with the non-image-formation portion of the photoreceptor drum.

According to the above-described structure, even when a portion of the toner transported on the developing sleeve is scattered between the non-magnetic portions of the developing sleeve and the non-image-formation portions of the photoreceptor drum, the scattered toner sticks to the tip surfaces of the seal members and portions of the surfaces of the seal member that are opposite the non-magnetic portion. Accordingly, there is no risk that toner sticks to the non-image-formation portions of the photoreceptor drum that are covered by the seal members.

However, the tip surfaces of the seal members are in contact with the non-image-formation portions of the photoreceptor drum. Therefore, toner sticking to the tip surfaces of the seal members may be brought into contact with the non-image-formation portions of the photoreceptor drum. There is a risk that the toner brought into contact with the non-image-formation portions may subsequently stick to the non-image-formation portions in a stripe pattern as a result of the rotation of the photoreceptor drum, and the toner is transferred to a recording sheet of enlarged A3 size simultaneously with a toner image.

When the toner is transferred to the peripheral margin of the recording sheet of enlarged A3 size in a stripe pattern, it is highly probable that a user recognizes the stripe pattern, and the user may have a concern that something is wrong.

SUMMARY OF THE INVENTION

In consideration of the problem described above, the present invention aims to provide a developing device and an image forming apparatus that prevent developer from sticking to the non-image-formation portions at the ends of the photoreceptor in the axial direction.

In order to achieve the above aim, one aspect of the present invention is a developing device for forming an image by developing, using a developer, an electrostatic latent image on a photoreceptor rotating about a rotation axis, the developing device having: a housing having an opening being located opposite the photoreceptor, the opening exposing therethrough a central portion of the photoreceptor that is located at the center of the photoreceptor in a direction along the rotation axis; a developing sleeve rotatably disposed inside the housing so as to face the central portion of the photoreceptor, the developing sleeve consisting of a central portion that is located at the center of the developing sleeve and end portions that are located at both sides of the central portion in the direction along the rotation axis; a magnetic body disposed inside the central portion of the developing sleeve, the end portions of the developing sleeve that are located at both sides of the central portion being no-magnet portions; and seal members supported by the housing, the seal members each including: a shielding portion that shields, from the developer, either one of portions of the photoreceptor that are located opposite the no-magnet portions; and a contact portion that is in surface contact with either one of end portions of the photoreceptor farther from a center of the photoreceptor than the no-magnet portions in the direction along the rotation axis, wherein each of the seal members includes, at an end thereof closer to the center of the photoreceptor than the other end in the direction along the rotation axis, a non-contact portion that is not in contact with the photoreceptor.

Another aspect of the present invention is an image forming apparatus forming a toner image on a recording sheet of a size larger than a maximum-size toner image formed on the photoreceptor, and including the developing device as described above.

BRIEF DESCRIPTION OF THE DRAWINGS

These and the other objects, advantages and features of the invention will become apparent from the following description thereof taken in conjunction with the accompanying drawings which illustrate a specific embodiment of the invention.

In the drawings.

DESCRIPTION OF THE PREFERRED EMBODIMENTS

The following describes embodiments of an image forming apparatus according to the present invention with reference to a tandem type color printer (hereinafter referred to simply as a "printer").

Embodiment 1

(Structure of Printer)

Figure 1:
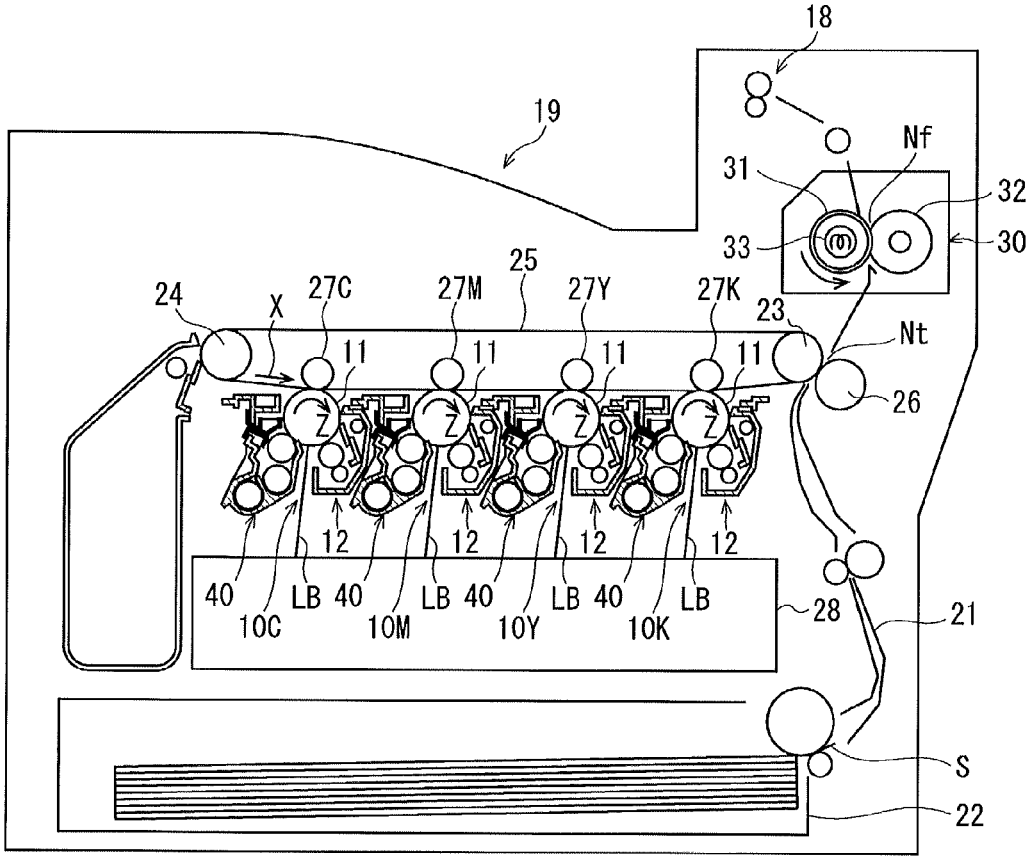
FIG. 1 is a schematic cross-sectional view illustrating a structure of a tandem type color printer as an example of an image forming apparatus including a developing device pertaining to an embodiment of the present invention.

FIG. 1 is a schematic cross-sectional view illustrating a structure of a printer pertaining to the present embodiment. The printer receives image data from, for example, an external terminal or the like via a communication network such as a LAN (Local Area Network), and, according to the image data, forms a full-color or monochrome toner image on a recording sheet S such as a recording paper sheet or OHP sheet using a well-known electro-photographic system.

The printer includes four process units 10C, 10M, 10Y, and 10K that are arranged in parallel in the horizontal direction and located substantially in the middle portion of the printer in the vertical direction. In addition, an intermediate transfer belt 25 is disposed above the process units 10C, 10M, 10Y, and 10K and along the horizontal direction. Furthermore, an exposing unit 28 emitting laser beams LB to the process units 10C, 10M, 10Y, and 10K is disposed below the process units 10C, 10M, 10Y, and 10K.

The intermediate transfer belt 25 is suspended by belt rotating rollers 23 and 24 that are disposed at the right side end and the left side end of the printer seen from the front side thereof. The belt rotating rollers 23 and 24 extend from the front face side to the rear face side of the printer. The intermediate transfer belt 25 rotates in the direction indicated by the arrow X.

Note that, hereinafter, the front face side of the printer is referred to as the "front side", and the rear face side thereof is referred to as the "rear side".

The process units 10C, 10M, 10Y, and 10K are arranged in this order along a bottom running portion of the intermediate transfer belt 25. The process units 10C, 10M, 10Y, and 10K form toner images in cyan (C), magenta (M), yellow (Y), and black (K), respectively, by using the laser beams LB emitted by the exposing unit 28. The toner images formed by the process units 10C, 10M, 10Y, and 10K are transferred to the outer surface of the intermediate transfer belt 25.

The process units 10C, 10M, 10Y, and 10K are substantially the same in the structure except for the color of toner. Accordingly, in the following description of the common structure of the process units 10C, 10M, 10Y, and 10K, they are each referred to as merely a "process unit 10" without reference characters C, M, Y, or K.

Figure 2:
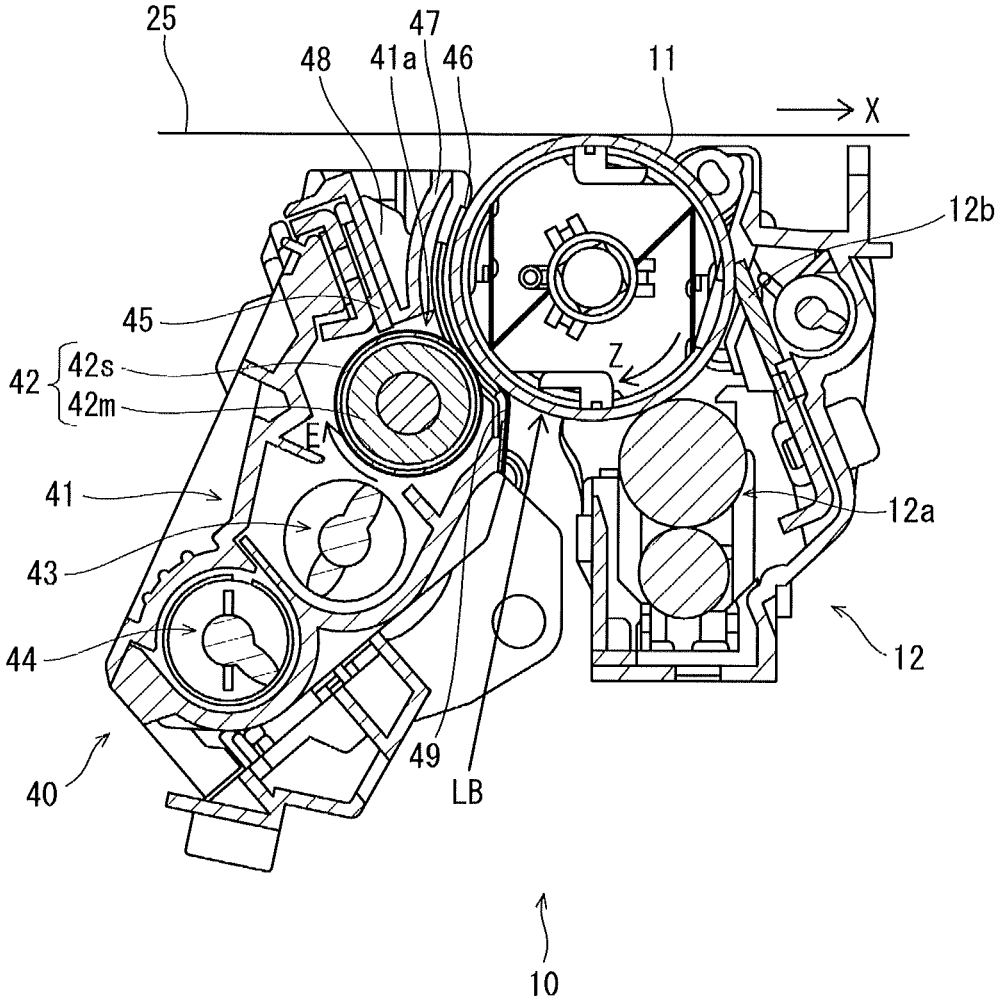
FIG. 2 is a schematic cross-sectional view illustrating a structure of a process unit disposed in the color printer.

FIG. 2 is a schematic cross-sectional view illustrating the structure of the process unit 10. The process unit 10 includes a photoreceptor drum 11 that faces the bottom running portion of the intermediate transfer belt 25. The photoreceptor drum 11 is disposed such that an axial direction thereof (i.e., a direction along the rotation axis thereof) is aligned with the direction of the printer from the front side to the rear side. That is, the axial direction of the photoreceptor drum 11 is orthogonal to the running direction of the bottom running portion of the intermediate transfer belt 25 (i.e., aligned with the width direction of the intermediate transfer belt 25).

The photoreceptor drum 11 of the process unit 10 is disposed such that the center thereof in the axial direction coincides with the center of the intermediate transfer belt 25 in the width direction thereof. The photoreceptor drum 11 rotates in the direction indicated by the arrow Z.

The process unit 10 includes a charging unit 12 and a developing device 40. The charging unit 12 is disposed downstream of the upper portion of the photoreceptor drum 11 facing the intermediate transfer belt 25 in the rotating direction of the photoreceptor drum 11. The developing device 40 is disposed upstream of the upper portion of the photoreceptor drum 11 in the rotating direction.

The discharging unit 12 includes a cleaning blade 12*b* for cleaning the surface of the photoreceptor drum 11 in the rotating direction thereof, and a charger 12*a* for uniformly charging the surface of the photoreceptor drum 11 at a predetermined potential.

The cleaning blade 12*b* cleans the surface of the photoreceptor drum 11 so as to remove residual toner and the like on the surface thereof. The charger 12*a* uniformly charges the surface of the photoreceptor drum 11 at the predetermined potential after the cleaning by the cleaning blade 12*b*.

The surface of the photoreceptor drum 11 charged at the predetermined potential is exposed by the laser beam LB emitted by the exposing unit 28 (see FIG. 1) disposed downstream of the charger 12 in the rotating direction of the photoreceptor drum 11. The exposing unit 28 emits the laser beam LB according to image data (i.e., page data) of an image to be formed on a recording sheet S. In this way, electrostatic latent images corresponding to cyan, magenta, yellow, and block images are formed on the photoreceptor drums 11.

Note that the exposing unit 28 exposes the photoreceptor drum 11 to form the electrostatic latent image, such that the center of the electrostatic latent image in a direction orthogonal to the transport direction of the recording sheet S used for image formation (hereinafter, referred to as the "width direction") coincides with the center of the photoreceptor drum 11 in the axial direction thereof.

The developing device 40 of the process unit 10 is disposed at a position downstream, in the rotating direction of the photoreceptor drum 11, of the exposure position where the photoreceptor drum 11 is exposed by the laser beam LB. The developing devices 40 included in the process units 10C, 10M, 10Y, and 10K each develop electrostatic latent image formed on the photoreceptor drum 11 by using color toner in cyan, magenta, yellow, or black. In this way, toner images in cyan, magenta, yellow, and black are formed on the surfaces of the photoreceptor drums 11. The structure of the developing device 40 is described in more detail below.

The toner images formed on the photoreceptor drums 11 are each transported, by the rotation of the photoreceptor drum 11, to a position opposite the bottom running portion of the intermediate transfer belt 25.

As shown in FIG. 1, within the running path of the intermediate transfer belt 25, four primary transfer rollers 27C, 27M, 27Y, and 27K are disposed above the process units 10C, 10M, 10Y, and 10K, respectively. The primary transfer rollers 27C, 27M, 27Y, and 27K are opposite the photoreceptor drums 11 of the process units 10C, 10M, 10Y, and 10K, respectively, across the bottom running portion of the intermediate transfer belt 25.

The toner images on the photoreceptor drums 11 is brought into contact with the bottom running portion of the intermediate transfer belt 25 due to the rotation of the photoreceptor drums 11. Voltage is applied to the primary transfer rollers 27C, 27M, 27Y, and 27K to generate electric fields. Under the effect of the electric fields, the toner images on the photoreceptor drums 11 are primarily transferred onto the surface of the bottom running portion of the intermediate transfer belt 25.

Note that, when a full-color toner image is formed, toner images in cyan, magenta, yellow, and black formed on the photoreceptor drums 11 included in the process units 10C, 10M, 10Y, and 10K are transferred and superposed in the same area of the intermediate transfer belt 25. In order to achieve this, the process units 10C, 10M, 10Y, and 10K are controlled to start image formation at timings different from one another.

In contrast, when a monochrome toner image is formed, selected one of the process units (e.g., the process units 10K using black toner) forms a monochrome toner image on the photoreceptor drum 11.

In either case, the toner image on the photoreceptor drum 11 is primarily transferred onto the intermediate transfer belt 25 in a manner that the center of the photoreceptor drum 11 in the axial direction coincides with the center of the intermediate transfer belt 25 in the width direction.

After the toner images on the photoreceptor drums 11 of the process units 10C, 10M, 10Y, and 10K have been transferred to the intermediate transfer belt 25, residual toner on the surface of each photoreceptor drum 11 is removed by the above-described cleaning blade 12*b*.

The toner images having been transferred onto the intermediate transfer belt 25 are transported toward the belt rotating roller 23 (shown on the right side in FIG. 1) by the rotation of the intermediate transfer belt 25. A secondary transfer roller 26 is pressed against the intermediate transfer belt 25 at a position where the belt rotating roller 23 supports the intermediate transfer belt 25. A transfer nip Nt is formed between the intermediate transfer belt 25 and the secondary transfer roller 26 at a position where they are in a pressed contact with each other. The toner images that have been transferred onto the intermediate transfer belt 25 are transported toward the transfer nip Nt by the rotation of the intermediate transfer belt 25.

The printer includes, in the bottom portion thereof, a sheet feeding cassette 22 that stores recording sheets S. The recording sheet S stored in the sheet feeding cassette 22 is transported along a sheet transport path 21 to a transfer nip Nt. The recording sheet S is transported in a manner that the center of the recording sheet S in the width direction thereof coincides with the center of the sheet transport path 21 in the width direction thereof. The recording sheet S is controlled to pass through the transfer nip Nt at a timing when the toner image on the intermediate transfer belt 25 passes through the transfer nip Nt. At the transfer nip Nt, the recording sheet S and the intermediate transfer belt 25 are superposed with the centers thereof in the width directions coinciding with each other.

When the recording sheet S passes through the transfer nip Nt, a transfer bias voltage is applied to the secondary transfer roller 26 to generate an electric field between the secondary transfer roller 26 and the intermediate transfer belt 25. Under the effect of the electric field, the toner image on the intermediate transfer belt 25 is secondarily transferred to the recording sheet S. The toner image is transferred in a manner that the center of the intermediate transfer belt 25 in the width direction thereof coinciding with the center of the recording sheet S in the width direction thereof.

The recording sheet S having passed through the transfer nip Nt is transported toward a fixing device 30 disposed above the secondary transfer roller 26. The fixing device 30 includes a heating roller 31 and a pressurizing roller 32 that are pressed against each other. A fixing nip Nf is formed between the heating roller 31 and the pressurizing roller 32 through which the recording sheet S passes. A heater lamp 33 is disposed inside, and on the axial of the heating roller 31. The heater lamp 33 heats the heating roller 31.

In the fixing device 30, the unfixed toner image on the recording sheet S is heated by the heating roller 31 while the recording sheet S is passing through a fixing nip Nf. In this way, the toner image is thermally fixed onto the recording sheet S. The recording sheet S onto which the toner image has been fixed is transported from the fixing device 30 toward the sheet ejecting roller 18, and subsequently ejected, by the sheet ejecting roller 18, onto a sheet ejection tray 19.

In the printer of the present embodiment, the maximum-size recording sheet that can be transported along the sheet transport path to the transfer nip Nt is enlarged A3 size that is greater than A3 size. Accordingly, any recording sheet S of a size smaller than enlarged A3 size is transported along the sheet transport path 21 to the transfer nip Nt, where a toner image is transferred to the recording sheet.

(Structure of Developing Device)

The following describes the structure of the developing device 40 included in the process unit 10 with reference to FIG. 2.

As shown in FIG. 2, the developing device 40 includes a developing housing 41 extending along the axial direction of the photoreceptor drum 11. The developing housing 41 stores therein two-component developer including non-magnetic toner (hereinafter, referred to as "toner") and magnetic carrier (hereinafter, referred to as "carrier"). In the developing housing 41, a developing roller 42, supply screw 43, and stirring screw 44 are disposed to be parallel with one another.

The developing housing 41 is provided with an opening 41*a* at a position opposite the photoreceptor drum 11. The opening 41*a* has a rectangular shape longer in the axial direction of the photoreceptor drum 11. The photoreceptor drum 11 is disposed to be opposite the opening 41*a* except for the end portions in the axial direction thereof.

The developing roller 42 includes a non-magnetic developing sleeve 42*s* disposed in parallel with the photoreceptor drum 11, and a magnetic body 42*m* having a cylindrical shape fitted in the developing sleeve 42*s* so as to be coaxial. The developing sleeve 42*s* rotates in a direction indicated by an arrow E in FIG. 2.

The developing sleeve 42*s*, is slightly shorter than the photoreceptor drum 11 in the axial direction thereof. The developing sleeve 42*s* is located such that the center thereof in the axial direction coincides with the center of the photoreceptor drum 11 in the axial direction.

The surface of the developing sleeve 42*s* is opposite a portion of the photoreceptor drum 11 other than the end portions thereof in the axial direction, the potion being exposed through the opening 41*a*. Through the opening 41*a*, the circumferential surface of the developing sleeve 42*s* and the surface of the photoreceptor drum 11 face each other with a substantially constant gap of approximately 0.3 mm. Hereinafter, the gap is referred to as a "developing gap".

The magnetic body 42*m* is fixed so as not to rotate in the developing sleeve 42*s*. The magnetic body 42*m* is provided with a plurality of magnetic poles (not shown) at appropriate intervals along a circumferential direction. Each magnetic pole has an elongate shape along the axial direction of the magnetic body 42*m*.

The length of the magnetic body 42*m* in the axial direction thereof is slightly shorter than that of the developing sleeve 42*s* in the axial direction thereof. The magnetic body 42*m* is disposed in the developing sleeve 42*s* with the center of the magnetic body 42*m* in the axial direction thereof coinciding with that of the developing sleeve 42*s* in the axial direction thereof. That is, the magnetic body 42*m* does not exist in the end portions of the developing sleeve 42*s* in the axial direction thereof. Hereinafter, the end portions of the developing sleeve 42*s* in the axial direction in which the magnetic body 42*m* does not exist are each referred to as a "no-magnet portion".

The supply screw 43 is disposed on the opposite side of the photoreceptor drum 11 relative to the developing roller 42*s*, and positioned below and close to the developing roller 42.

The stirring screw 44 is disposed on the opposite side of the developing roller 42 relative to the supply screw 43, and positioned close to the supply screw 43.

The developing sleeve 42*s*, supply screw 43, and stirring screw 44 are rotatably disposed the developing housing 41 from the front end to the rear end thereof. The supply screw 43 and the stirring screw 44 rotate in opposite directions.

When an electrostatic latent image on the photoreceptor drum 11 is developed, the stirring screw 44, supply screw 43, and developing sleeve 42*s* all rotate. Consequently, the two-component developer (hereinafter, merely referred to as "developer") in the developing housing 41 is stirred and transported by the stirring screw 44 along the axial direction thereof. In this way, the developer including the charged toner is supplied to the supply screw 43.

The developer supplied to the supply screw 43 is transported by the rotating supply screw 43 in the axial direction thereof, and, while being transported, the developer is transferred to, and held on the outer circumference of the rotating developing sleeve 42*s*, at a position opposite the developing sleeve 42*s*, under the effect of the magnetic poles of the magnetic body 42*m*. The developer held on the developing sleeve 42*s* forms an electromagnetic brush on the outer circumference of the developing sleeve 42*s*, and is transported.

The developing device 40 includes a developer regulating plate 45 for regulating the amount of developer transported on the outer circumferential surface of the developing sleeve 42*s*. The developer regulating plate 45 is located upstream of the developing gap in the rotating direction of the developing sleeve 42*s*. The developer on the developing sleeve 42*s* is transported to the developing gap after the amount thereof is regulated appropriately by the developer regulating plate 45.

An electric field is formed in the developing gap by the developing bias voltage applied to the developing sleeve 42*s* and the surface potential of the photoreceptor drum 11. The toner in the developer transported on the developing sleeve 42*s* sticks to the electrostatic latent image on the photoreceptor drum 11 under the effect of the electric field formed in the developing gap. In this way, the electrostatic latent image on the photoreceptor drum 11 is developed by the toner, and, consequently, a toner image is formed on the photoreceptor drum 11.

Figure 3:
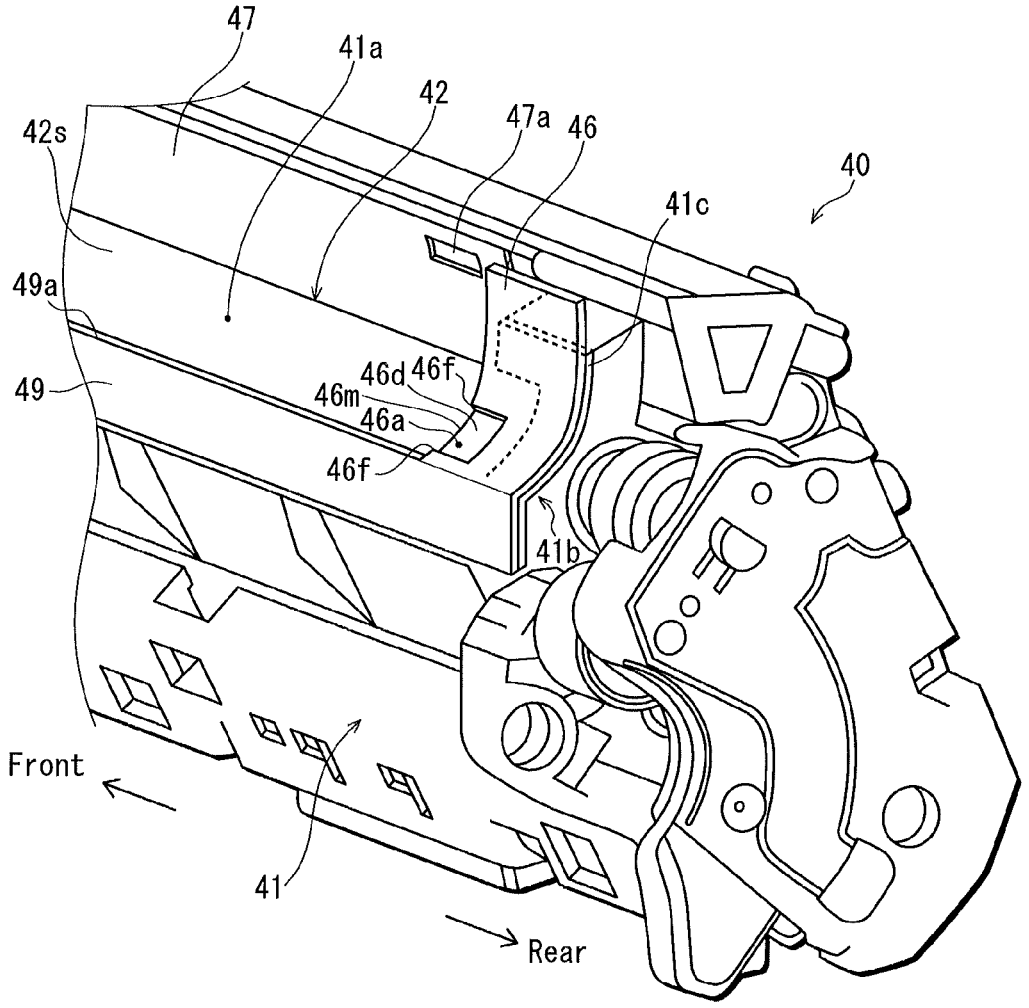
FIG. 3 is a perspective view of a portion of a developing device in the process unit on the rear side of the printer.
Figure 4:
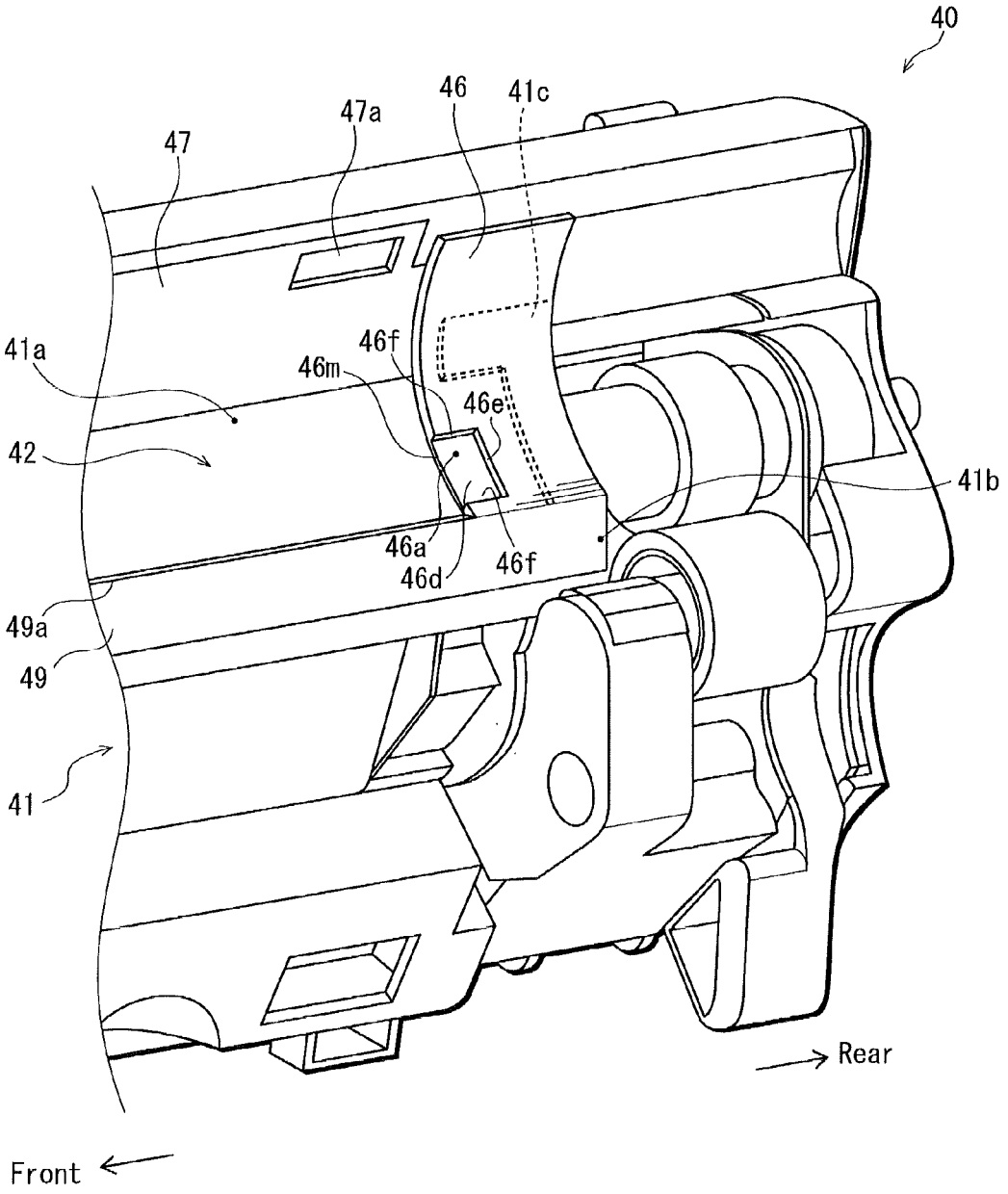
FIG. 4 is a perspective view of the portion of the developing device on the rear side of the printer shown in FIG. 3.
Figure 5:
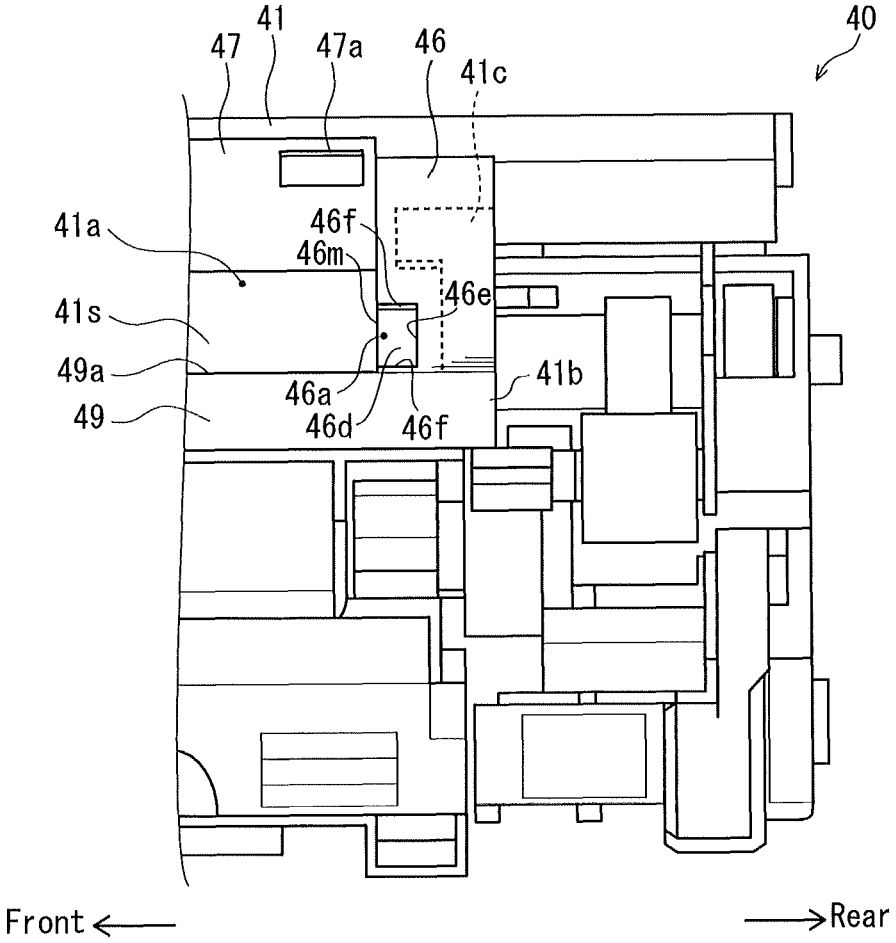
FIG. 5 is a side view of the portion of a developing device on the rear side of the printer shown in FIG. 3.
Figure 6:
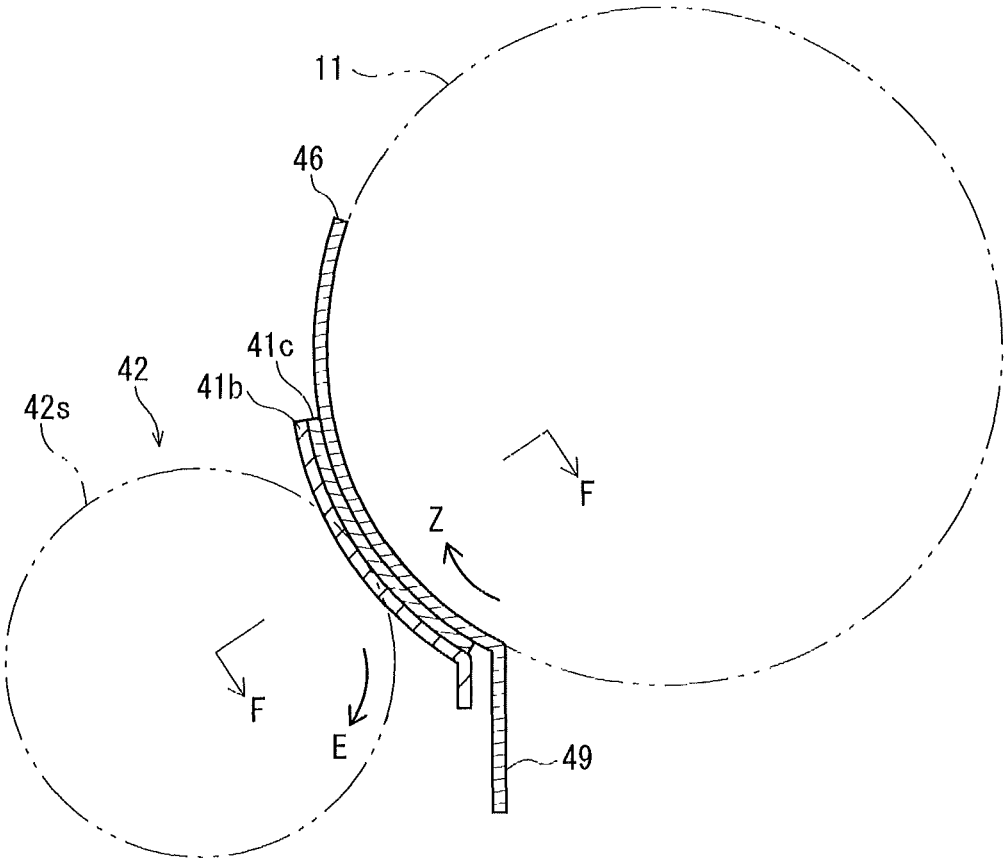
FIG. 6 is a cross-sectional view of the portion of a developing device on the rear side of the printer shown in FIG. 3.
Figure 7:
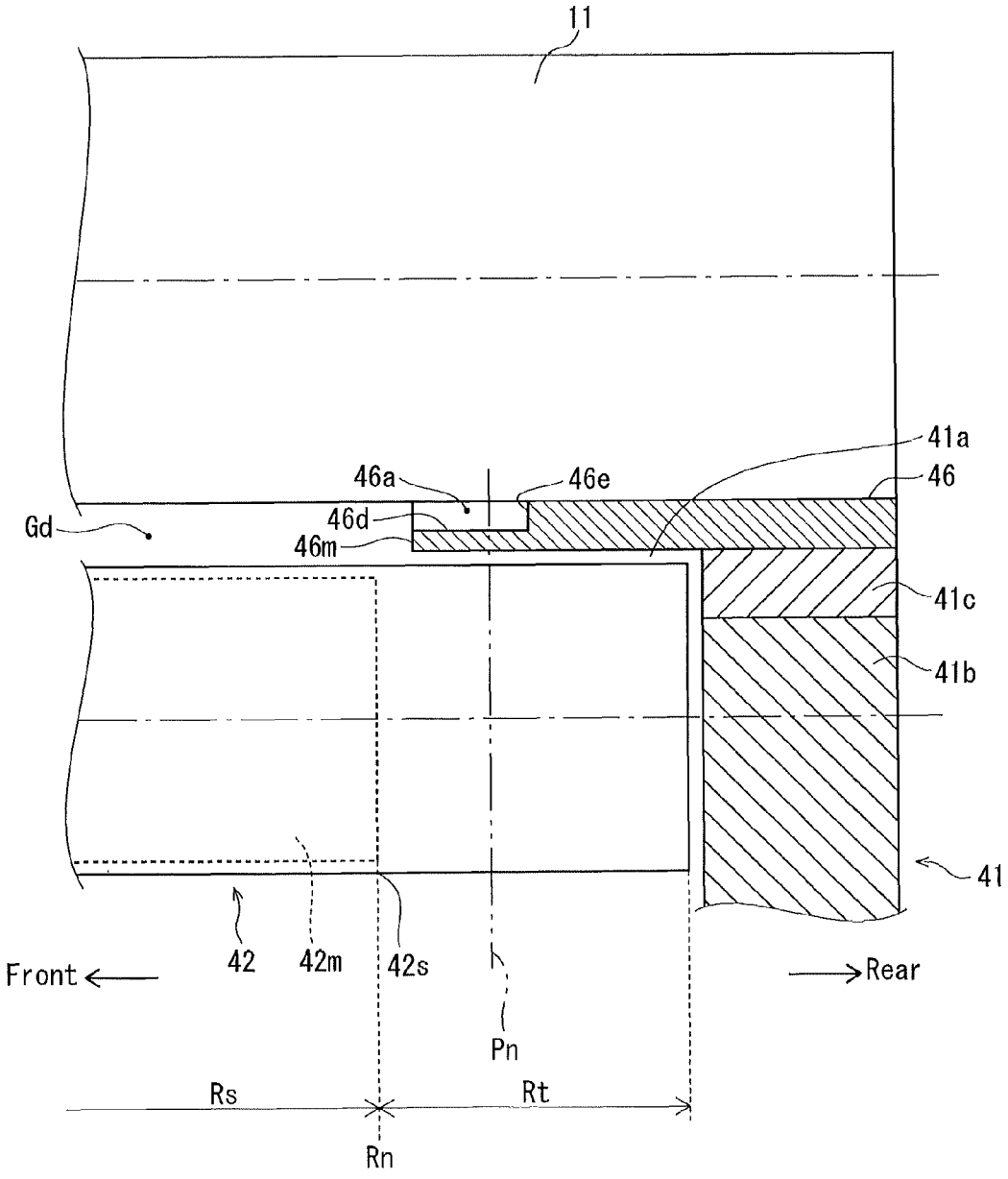
FIG. 7 is a schematic cross-sectional view along a line F-F in FIG. 6.

FIG. 3 is a perspective view of a rear end portion of the developing device 40 viewed from the rear side. FIG. 4 is a perspective view of the rear end portion of the developing device 40 viewed from the front side. FIG. 5 is a side view of the rear end portion of the developing device 40 shown in FIG. 3. FIG. 6 is a cross-sectional view showing the section of the rear end portion of the developing device 40 shown in FIG. 3. FIG. 7 is a schematic cross-sectional view showing the section along the line F-F in FIG. 6.

Note that the structure of a front end portion of the developing device 40 is the same as the rear end portion except for arrangement direction of the elements included therein (i.e., from the front side to the rear side or vice versa). Accordingly, the following describes only the structure of the rear end portion of the developing device 40 with reference to FIGS. 3 to 7. Detailed description is omitted for the structure of the front end portion.

As shown in FIG. 7, the rear end portion of the photoreceptor drum 11 is located closer to the rear side of the printer than the opening 41*a* provided in the developing housing 41. In the present embodiment, the length of the photoreceptor drum 11 in the axial direction thereof is 360 mm.

The developing housing 41 includes a side seal (seal member) 46 that seals between the rear end portion of the photoreceptor drum 11 and a rear end portion of the developing housing 41. The side seal 46 is fixed to a seal supporting member 41*b* provided on the rear end portion of the developing housing 41 by an elastic seal member 41*c* inserted therebetween.

As shown in FIGS. 3 and 4, the seal supporting member 41*b* has a curved surface forming an arc along the surface of the photoreceptor drum 11 so as to allow the rear end portion of the photoreceptor drum 11 to be fit on the seal supporting member 41*b*. The curved surface is located adjacent to the opening 41*a* and closer to the rear side of the printer than the opening 41*a*. As shown in FIG. 6, the middle portion of the curved surface in the circumferential direction thereof is located closer to the rear side of the printer than the developing gap that is indicated by the reference character "Gd".

As shown in FIGS. 3 to 5, the side seal 46 is a curved rectangular sheet made of polyethylene terephthalate (PET) and having a thickness of approximately 100 μm. As shown in FIG. 3, the side seal 46 has a shape matching the circumferential surface of the photoreceptor drum 11. As shown in FIG. 6, a downstream portion of the side seal 46 in the rotating direction of the photoreceptor drum 11 is located downstream of a downstream portion of the seal supporting member 41*b* in the rotating direction.

As shown in FIG. 7, the front end portion of the side seal 46 is located closer to the front side of the printer than the seal supporting member 41*b*. Accordingly, the side seal 46 is located within the developing gap Gd so as to shield, from toner, a downstream portion of the photoreceptor drum 11 in the rotating direction thereof. Furthermore, as shown in FIG. 6, the upstream end portion of the side seal 46 in the rotating direction of the photoreceptor drum 11 (i.e., the direction Z in FIG. 6) extends, to some extent, from the developing gap Gd in the rotating direction of the photoreceptor drum 11.

As shown in FIG. 7, the side seal 46 is supported by the elastic seal member 41*c* disposed on the seal supporting member 41*b*, and is pressed against, and in surface contact with the rear end portion of the photoreceptor drum 11. Consequently, sealing is provided between the rear end portion of the developing housing 41 and the rear end portion of the photoreceptor drum 11.

In the developing gap Gd, the side seal 46 covers the non-image-formation portion of the photoreceptor drum 11 with a gap between the surface of the developing sleeve 42*s* and the side seal 46.

As described above, the side seal 46 is pressed against, and in surface contact with the photoreceptor drum 11 only at the rear end portion thereof that is located on the elastic seal member 41*c*. Accordingly, the portion of the side seal 46 extending toward the front side of the printer beyond the elastic seal member 41*c* is not subject to the pressing force of the elastic seal member 41*c*. In the developing gap Gd, the portion of the side seal 46 that extends toward the front side beyond the elastic seal member 41*c* is nearly entirely in contact with the photoreceptor drum 11.

As shown in FIG. 7, the rear side portion of the developing sleeve 42*s* extends toward the front side beyond the seal supporting member 41*b*. As described above, the rear side portion of the developing sleeve 42*s* forms the no-magnet portion Rt in which the magnetic body 42*m* does not exist. Note that the front end portion of the developing sleeve 42*s* also forms a no-magnet portion in which the magnetic body 42*m* does not exist.

The magnetic body 42*m* in the present embodiment has a length of 312 mm in the axial direction thereof. The length is slightly greater than the length (297 mm) of a recording sheet S of A3 size in the width direction thereof.

The magnetic force of the magnetic poles provided on the magnetic body 42*m* does not act on the no-magnet portions Rt on the front end side and rear end side of the developing sleeve 42*s*. Accordingly, no magnetic brush is formed on the no-magnet portions Rt. Therefore, developer is not transported to the no-magnet portions Rt even when the developing sleeve 42*s* rotates. The portions of the photoreceptor drum that is opposite the no-magnet portions are each referred to as a "non-image-formation portion" on which no toner image is formed.

The surface of the developing sleeve 42*s* except for the no-magnet portions Rt is capable of carrying developer using the magnetic force of the magnetic body 42*m*, and forms a toner image on the photoreceptor drum 11. Accordingly, the surface of the developing sleeve 42*s* except for the no-magnet portions Rt is referred to as a "toner image formation area Rs": The length of the toner image formation area Rs in the axial direction of the developing sleeve 42*s* is equal to the length of the magnetic body 42*m* in the axial direction thereof (i.e., 312 mm). Hereinafter, the boundary between the no-magnet portion Rt and the toner image formation area Rs is referred to as a "magnet boundary". In FIG. 7, the boundary is indicated by a reference character "Rn".

The following describes, with reference to FIG. 7, the positional relation between a recording sheet S of enlarged A3 size that is transported to the transfer nip NT, the developing device 40, and the photoreceptor drum 11.

As described above, the toner image on the photoreceptor drum 11 is transferred to the intermediate transfer belt 25 with the center of the photoreceptor drum 11 in the axial direction thereof coinciding with the center of the intermediate transfer belt 25 in the width direction thereof. The toner image on the intermediate transfer belt 25 is transferred to the recording sheet S with the center of the intermediate transfer belt 25 in the width direction thereof coinciding with the center of the recording sheet S in the width direction thereof. Accordingly, the center of the photoreceptor drum 11 in the axial direction thereof coincides with that of the recording sheet S in the width direction thereof.

The recording sheet S of enlarged A3 size is not defined in the standard. In the present embodiment, the recording sheet S of enlarged A3 size has a length of 320 mm in the width direction. In FIG. 7, the position of the edge of the recording sheet S of enlarged A3 size closer to the rear side of the printer is indicated by a two-dot chain line Pn. Note that, hereinafter, the position of the edge of an area of the developing sleeve corresponding in location to the recording sheet S of enlarged A3 size is referred to as a "enlarged size side edge position Pn". In the present embodiment, the length of the toner image formation area Rs in the axial direction is 312 mm. Accordingly, the enlarged size side edge position Pn is closer to the rear side of the printer than the rear edge of the toner image formation area Rs by 4 mm.

A tip surface 46*m* of the side seal 46 on the side closer to the center of the photoreceptor drum 11 in the axial direction thereof is located within the developing gap Gd to be closer to the rear side of the printer than the magnetic body 42*m* and closer to the front side of the printer than the enlarged size side edge position Pn. The tip surface 46*m* of the side seal 46 located as described above extends along the circumferential direction of the photoreceptor drum 11.

As shown in FIGS. 3 to 5 and 7, the side seal 46 is provided with a non-contact portion 46*a* having a smaller thickness than the remaining portion of the side seal 46. The non-contact portion 46*a* is provided at the end that exists in the developing gap Gd, on the side opposite the photoreceptor drum 11. A space is defined between the non-contact portion 46*a* and the photoreceptor drum 11. The space communicates with the developing gap Gd. Accordingly, the non-contact portion 46*a* is not in contact with the photoreceptor drum 11.

In the present embodiment, the non-contact portion 46*a* in the rotating direction of the photoreceptor drum 11 so as not to reach a downstream end of the side seal 46 in the rotating direction.

The non-contact portion 46*a* is surrounded by: a pair of axial direction wall surfaces 46*f* (see FIGS. 3 to 5) opposite each other; and a circumferential direction wall surface 46*e* (see FIGS. 4, 5, and 7). The pair of axial direction wall surfaces 46*f* are formed with an interval in the circumferential direction of the photoreceptor drum 11, and each extending along the axial direction of the photoreceptor drum 11. The circumferential direction wall surface 46*e* connects the rear edges of the pair of axial direction wall surfaces 46*f*. The circumferential direction wall surface 46*e* is formed along the circumferential direction of the photoreceptor drum 11 at a position separated from the tip surface 46*m* of the side seal 46 by a predetermined distance in the axial direction of the photoreceptor drum 11.

The circumferential direction wall surface 46*e* and the pair of axial direction wall surfaces 46*f* are each in contact with the surface of the photoreceptor drum 11. The non-contact portion 46*a* has a rectangular surface 46*d* opposite the photoreceptor drum 11 with a gap (interval) therebetween. Accordingly, the side seal has a smaller thickness at the non-contact portion 46*a* than at the portion other than the non-contact portion 46*a*. The thickness corresponds to the length in the radial direction of the photoreceptor drum 11 (i.e., height).

In general, the length of the non-contact portion 46*a* along the axial direction of the photoreceptor drum 11 is no greater than 100 times the thickness of the side seal 46, and is approximately 3 to 4 mm. The circumferential direction wall surface 46*e* is located closer to the rear side of the printer than the enlarged size side edge position Pn. The interval between the pair of axial direction wall surfaces 46*f* is slightly larger than the length (approximately 3 to 4 mm) of the non-contact portion 46*a* along the axial direction of the photoreceptor drum 11.

The thickness of the side seal 46 is constant except for the non-contact portion 46*a*. The difference in thickness between the non-contact portion 46*a* and the other portion is constant. In the present embodiment, the difference in thickness is at least 50 μm.

Note that the side seal 46 is made of a PET sheet having a relatively small thickness in order to form a proper gap between the side seal 46 and the surface of the developing sleeve 42*s* in the developing gap Gd. Consequently, the side seal 46 has small stiffness as a whole, and the tip portion forming the non-contact region 46*a* has even smaller stiffness. However, the length of the non-contact region 46*a* along the axial direction of the photoreceptor drum 11 is relatively short (i.e., no greater than 100 times the thickness of the side seal 46). Accordingly, there is no risk that the side seal 46 may wave at the non-contact portion 46*a* during the rotation of the photoreceptor drum 11. Consequently, the surface 46*d* of the non-contact region 46*a* does snot come into contact with the photoreceptor drum 11.

As described above, the front end portion of the developing device 40 has a structure in which the elements included therein are arranged in a reverse direction from the direction in which elements included in the rear end portion are arranged. In other words, the developing device 40 is provided with a side seal at the end closer to the front side, and the side seal has a structure in which the arrangement direction of the portions and surfaces thereof is reverse from that in the side seal 46 closer to the rear side disposed at the rear side of the printer.

As shown in FIGS. 3 and 4, the developing housing 41 is provided with a toner powder scattering prevention plate 47 downstream of the opening 41*a* of the developing housing 41 in the rotating direction of the photoreceptor drum 11. The toner powder scattering prevention plate 47 serves to prevent, for example, toner powder from being scattered like smoke. The toner powder scattering prevention plate 47 is disposed to cover the entire opening 41*a* from the front end to the rear end thereof.

The toner powder scattering prevention plate 47 is provided, in the rear end portion thereof, with a collecting hole 47*a* for collecting toner powder. The collecting hole 47*a* is located adjacent to the rear end of the toner powder scattering prevention plate 47 in the rotating direction of the photoreceptor drum 11. Note that another collecting hole having a similar shape is disposed near the front end of the toner powder scattering prevention plate 47.

A duct 48 is disposed along the photoreceptor drum 11 (see FIG. 2). The duct 48 is formed to extend along a direction from the front end to the rear end of the developing housing 41. The rear end of the duct 48 extends beyond the rear end of the developing housing 41. The duct 48 is configured such that air inside the duct 48 is sucked from the end thereof.

When the air inside the duct 48 is sucked out from the rear end thereof, the air between the toner powder scattering prevention plate 47 and the photoreceptor drum 11 is sucked into the duct 48 through the collecting hole 47*a*. In this way, toner powder such as toner that is present between the toner powder scattering prevention plate 47 and the photoreceptor drum 11 is sucked together with the air into the duct 48 through the collecting hole 47*a*. The toner powder in the duct 48 is collected from the rear end of the duct 48.

The side seal includes a portion that is (i) located downstream of the opening 41*a* of the developing housing 41 in the rotating direction of the photoreceptor drum 11, (ii) located closer to the rear side of the printer than the toner powder scattering prevention plate 47, and (iii) extends along the toner powder scattering prevention plate 47 in the in the rotating direction. Accordingly, the downstream end portion of the side seal 46 located downstream in the rotating direction of the photoreceptor drum 11 is located closer to the rear side of the printer than the collecting hole 47*a*. The non-contact portion 46*a* is formed only in a portion of the side seal 46 that extends in the developing gap Gd. The non-contact portion 46*a* does not extend beyond the collecting hole 47*a* toward the rear side of the printer. Hole.

As shown in FIGS. 3 and 4, the developing housing 41 is provided with a strip-shaped axial direction seal member 49 that is located downstream of the opening 41*a* in the rotating direction of the developing sleeve 42*s*, and that extends along the axial direction of the developing sleeve 42*s*. The axial direction seal member 49 and the side seal 46 are made of the same material and integrated into one piece.

The side edge 49*a* of the axial direction seal member 49 that is closer to the photoreceptor drum 11 than the other edge is, in contact with the surface of the photoreceptor drum 11 across the entire length from the front end to the rear side. Accordingly, a side edge of the opening 41*a* opposite the photoreceptor drum 11 is sealed by the axial direction seal member 49. This structure prevents toner inside the developing housing 41 from being scattered to the outside.

(Function of Side Seal)

The following describes the function of the side seal 46 when "marginless printing" is performed on a recording sheet of A3 size by the printer pertaining to the present embodiment. In the case of the marginless printing, a toner image having the same size as a recording sheet S of A3 size is formed on the photoreceptor drum 11, and transferred to a recording sheet S of enlarged A3 size.

The developing device 40 forms the toner image of A3 size on the photoreceptor drum 11 using the entire toner image formation area Rs of the developing sleeve 42*s*. In this case, toner images as printer's marks are also formed on the photoreceptor drum 11.

In order to form toner images of printer's marks, toner is transported on a portion of the developing sleeve 42*s* that is in the vicinity of the magnetic boundary Rn of the toner image formation area Rs. The magnetic force acting on the toner is smaller than that acts on the toner image formation area Rs, because the magnetic body 42*m* does not exist in the no-magnet portion Rt. Accordingly, a portion of the toner transported onto the portion in the vicinity of the magnetic boundary Rn is scattered to the no-magnet portion Rt (i.e., a portion of the developing sleeve 42*s* at the end thereof in the axial direction) due to the centrifugal force generated by the rotation of the developing sleeve 42*s*.

However, in the developing gap Gd, the non-image-formation portion of the photoreceptor drum 11 is shielded from toner by the side seal 46 except for a portion in the vicinity of the toner image formation area. Consequently, the toner that has been scattered to the no-magnet portion Rt of the developing sleeve 42*s* is transferred to and sticks to a portion of the side seal 46 facing the developing sleeve 42*s* and the tip surface 46*m* thereof. Accordingly, there is no risk that the toner sticks to the non-image-formation portion of the photoreceptor drum 11 that is shielded by the side seal 46.

The non-contact region 46*a* that is not in contact with the photoreceptor drum 11 is formed at the tip end of the side seal 46 as described above. Therefore, in the developing gap Gd, the tip surface 46*m* of the side seal 46 does not come into contact with the surface of the photoreceptor drum 11. Accordingly, even if toner sticks to the tip surface 46*m* of the side seal 46 in the developing gap Gd, there is no risk that the toner sticking to the tip surface 46*m* is transferred to the photoreceptor drum 11.

Therefore, there is no risk that toner sticks to the non-image-formation portion of the photoreceptor drum 11 in a stripe pattern. Accordingly, toner is prevented from sticking to the margin of a recording sheet S of enlarged A3 size in a stripe pattern.

Note that, in a gap between the non-contact portion 46*a* of the side seal 46 and the photoreceptor drum 11, air does not flow along the axial direction of the photoreceptor drum 11. Accordingly, toner having been scattered to the no-magnet portion Rt rarely enters the non-contact portion 46*a*. Even if the toner enters the gap between the non-contact portion 46*a* and the photoreceptor drum 11, the toner that enters is small in amount and sticks to different areas of the non-image-formation portion of the photoreceptor drum 11 dispersedly. Accordingly, if toner sticks to the recording sheet S of enlarged A3 size, users do not recognize the toner.

As described above, the present embodiment prevents toner from sticking to the periphery of a recording sheet S of enlarged A3 size in a stripe pattern. Consequently, there is no risk that a user recognizes toner sticking to the periphery of the recording sheet S of enlarged A3 size when the recording sheet S is printed out. Accordingly, the user does not have a concern that some problem has occurred.

Embodiment 2

Figure 8A:
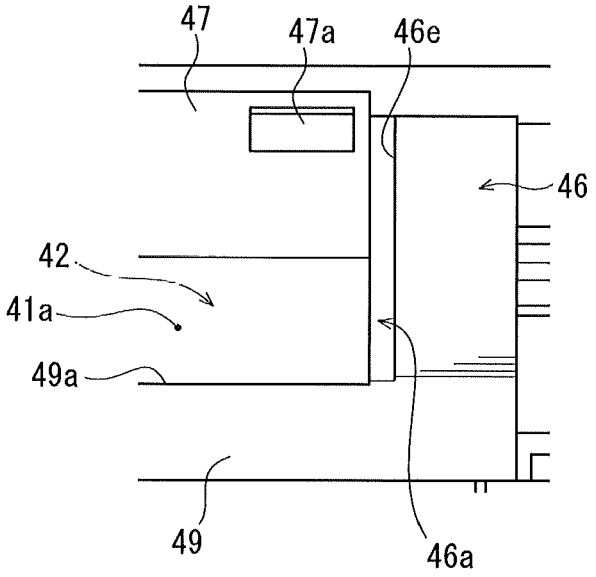
FIG. 8A is a perspective view of a portion of a developing device pertaining to another embodiment on a rear side of a printer.
Figure 8B:
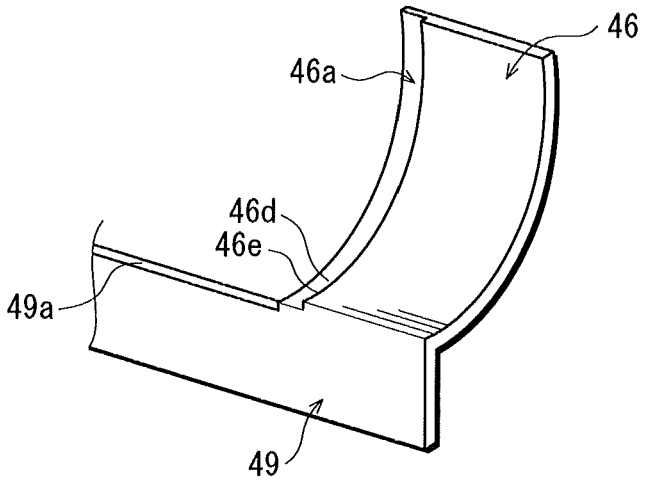
FIG. 8B is a perspective view of a side seal disposed in the developing device.

The structure of the side seal 46 is not limited to that in Embodiment 1. For example, the side seal 46 may be configured as shown in FIGS. 8A and 8B. The side seal 46 shown in FIGS. 8A and 8B includes a non-contact portion 46*a* that is formed along the rotating direction of the photoreceptor drum 11 from the upstream end to the downstream end of the side seal 46 in the rotating direction of the photoreceptor drum 11. Note that non-contact portion 46*a* may be formed to reach one of the upstream end and the downstream end.

The non-contact portion 46*a* defines a space opening toward the center of the photoreceptor drum 11 along the axial direction of the toner powder scattering prevention plate 47. The end of the non-contact portion 46*a* located on the downstream side in the rotating direction of the photoreceptor drum 11 is located at a position closer to the rear side of the printer than the collecting hole 47*a*. Accordingly, the non-contact portion 46*a* opening toward the center of the photoreceptor drum 11 faces the collecting hole 47*a*.

The non-contact portion 46*a* has a constant thickness smaller by that of the remaining portion of the side seal 46 by at least 50 μm, similarly to in Embodiment 1. The length of the non-contact portion 46*a* in the axial direction of the developing sleeve 42*s* is no greater than 30 times the thickness of the side seal 46.

The side seal 46 configured as described above also has the tip surface 46*m* that does not come into contact with the photoreceptor drum 11 in the developing gap Gd. Consequently, even when toner having been scattered from the developing sleeve 42*s* to the no-magnet portion Rt sticks to the tip surface 46*m* of the side seal 46, the toner never sticks to the non-image-formation portion of the photoreceptor drum 11 in a stripe pattern. Accordingly, toner is prevented from sticking to a margin of a recording sheet S of enlarged A3 size in a stripe pattern.

When air is sucked into the duct 48 through the collecting hole 47*a*, the air flows along the toner powder scattering prevention plate 47. Simultaneously, air in the non-contact portion 46*a* of the side seal 46 also flows in the circumferential direction of the photoreceptor drum 11. Consequently, if toner having been scattered from the developing sleeve 42*s* to the no-magnet portion Rt enters the gap between the non-contact portion 46*a* of the side seal 46 and the photoreceptor drum 11, the toner flows in the gap in the circumferential direction, and, subsequently, is sucked through the collecting hole 47*a*. Accordingly, the toner entering the gap is prevented from sticking to the non-image-formation portion of the photoreceptor drum 11.

Embodiment 3

Figure 9A:
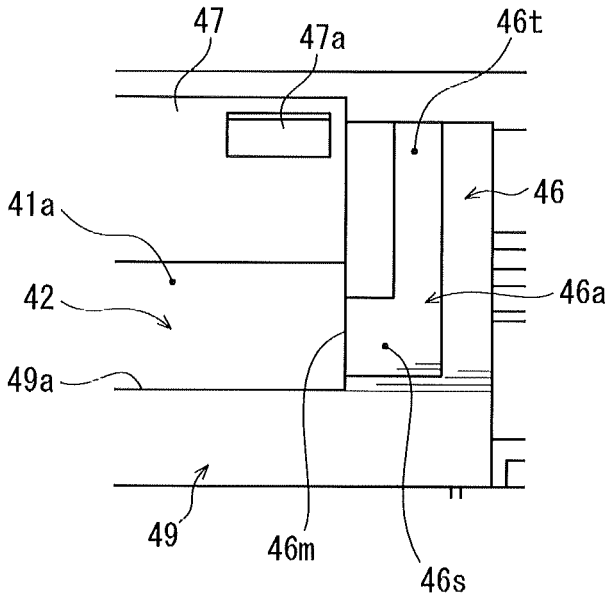
FIG. 9A is a perspective view of a portion of a developing device pertaining to yet another embodiment, seen from a rear side of a printer
Figure 9B:
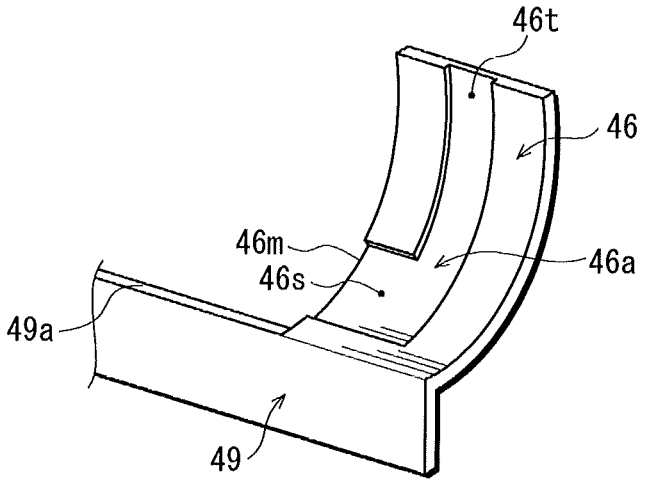
FIG. 9B is a perspective view of a side seal disposed in the developing device.

In the present embodiment, the non-contact portion 46*a* of the side seal 46 is configured as shown in FIGS. 9A and 9B. The non-contact portion 46*a* of the side seal 46 in the present embodiment includes a first portion 46*s* that is similar to the non-contact portion 46*a* of the side seal 46 in Embodiment 1, and a second portion 46*t* extending downstream in the rotating direction of the photoreceptor drum 11 from the rear side portion of the first portion 46*s*.

The first portion 46*s* and the second portion 46*t* connect with each other. The second portion 46*t* defines a space opening on the downstream side thereof in the rotating direction of the photoreceptor drum 11. The non-contact portion 46*a* has a constant thickness in both the first portion 46*s* and the second portion 46*t* that is smaller by 50 μm than in the remaining portion of the side seal 46. The remaining portion other than the non-contact portion 46*a* has another constant thickness.

The tip surface 46*m* of the side seal 46 configured as described above is also prevented by the non-contact portion 46*a* from coming into contact with the photoreceptor drum 11 in the developing gap Gd. Consequently, even when toner having been scattered from the developing sleeve 42*s* to the no-magnet portion Rt sticks to the tip surface 46*m* of the side seal 46, the toner never sticks to the photoreceptor drum 11. Accordingly, toner is prevented from sticking to a margin of a recording sheet S of an enlarged A3 size in a stripe pattern.

Air in the gap between the second portion 46*t* of the non-contact portion 46*a* and the photoreceptor drum 11 flows toward the collecting hole 47*a* by being sucked into the duct 48 through the collecting hole 47*a*. Therefore, if a portion of toner having been scattered from the developing sleeve 42*s* to the no-magnet portion Rt enters the gap, the portion of toner flows toward the collecting hole 47*a*. Accordingly, the toner is prevented from sticking to the non-image-formation portion of the photoreceptor drum 11.

In this case, similarly to in Embodiment 1, the rear end of the first portion 46*s* (i.e., the end closer to the rear side of the printer than the other end in the axial direction) is located closer to the rear side of the printer than the enlarged size side edge position Pn in the axial direction. That is, the rear end of the first portion 46*s* is located closer to the rear side of the printer in the axial direction than a sheet transport area on the photoreceptor drum 11 when a recording sheet S of an enlarged A3 size, which is the maximum transportable size of the printer, passes through the transfer nip Nt. Accordingly, even if the toner entering the gap between the non-contact portion 46*a* and the photoreceptor drum 11 sticks to the rear end of the first portion 46*s* while flowing from the first portion 46*s* to the second portion 46*t*, there is no risk that the toner sticks to the recording sheet S of the enlarged A3 size.

Embodiment 4

Figure 10A:
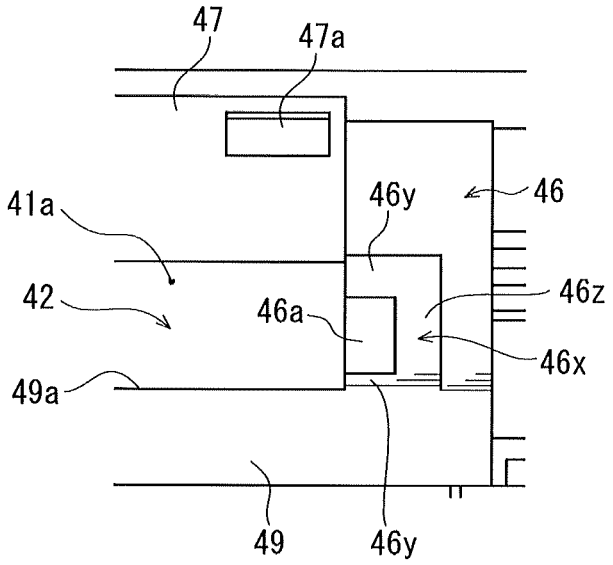
FIG. 10A is a perspective view of a portion of a developing device pertaining to still another embodiment, seen from a rear side of a printer
Figure 10B:
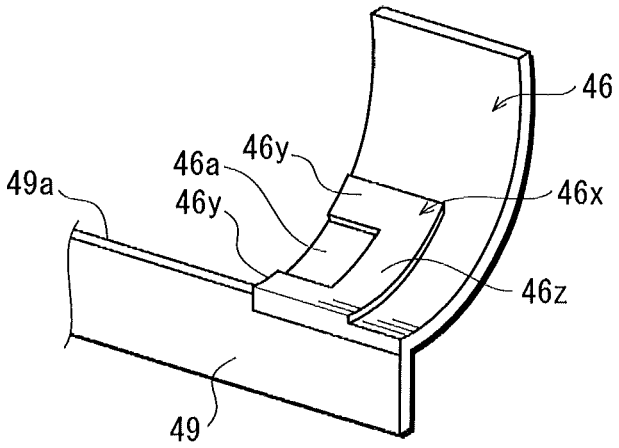
FIG. 10B is a perspective view of a side seal disposed in the developing device.

The side seal 46 in the present embodiment is configured as shown in FIGS. 10A and 10B. In the present embodiment, the non-contact portion 46*a* is surrounded by a convex portion 46*x* that protrudes toward the photoreceptor drum 11, instead of being formed to have a smaller thickness than the remaining portion of the side seal 46 as in Embodiment 1. The space of the non-contact portion 46*a* surrounded by the convex portion 46*x* is formed at the same position, and has the same shape and size as those of the non-contact portion 46*a* in Embodiment 1.

The convex portion 46*x* includes a pair of axial direction wall portions 46*y* each extending along the axial direction of the photoreceptor drum 11, and a circumferential direction wall portion 46*z* that is formed along the circumferential direction of the photoreceptor drum 11 so as to connect the pair of the axial direction wall portions 46*y* at the ends thereof located closer to the rear side of the printer. The space surrounded by the convex portion 46*x* opens toward the front side of the printer similarly to the non-contact portion 46*a* in Embodiment 1.

Each of the pair of axial direction wall portions 46*y* of the convex portion 46*x* is formed to extend from the tip surface 46*m* of the side seal 46 along the axial direction of the photoreceptor drum 11, and has a predetermined length.

The side seal 46 has a constant thickness except for the convex portion 46*x*. The axial direction wall portions 46*y* and the circumferential direction wall portion 46*z* of the convex portion 46*x* has a constant height from the surface of the remaining portion of the side seal 46 other than the convex portion 46*x* (i.e., difference in thickness between the convex portion 46*x* and the remaining portion). The constant height is at least 50 μm.

As described above, the portion surrounded by the convex portion 46*x* has a thickness (i.e., length or height in the radius direction of the photoreceptor drum 11) that is smaller than that of the convex portion 46*x*.

The side seal 46 configured as described above is pressed, in surface contact, against the photoreceptor drum 11 by the elastic seal member 41*c* only at the rear end thereof, similarly to the side seal in the above-described Embodiment 1. Therefore, all the surfaces of the pair of axial direction wall portions 46*y* and the circumferential direction wall portion 46*z* that are opposite the photoreceptor drum 11 are in contact with the surface of the photoreceptor drum 11. Accordingly, the non-contact portion 46*a* that is not in contact with the surface of the photoreceptor drum 11 is formed as the portion surrounded by the pair of axial direction wall portions 46*y* and the circumferential direction wall portion 46*z*.

The side seal 46 as configured above is not in contact with the photoreceptor drum 11. Therefore, even if toner having been scattered from the developing sleeve 42*s* to the no-magnet portion Rt the portion of the developing gap Gd sticks to the tip surface 46*m* of the side seal 46, the toner does not come into contact with the photoreceptor drum 11. Accordingly, the side seal 46 pertaining to the present embodiment also prevents toner from sticking to the non-image-formation portion of the photoreceptor drum 11 in a stripe pattern.

Note that the convex portion 46*x* of the side seal 46 may be integrally molded with the side seal 46. However, alternatively, the convex portion 46*x* having a predetermined shape may be molded separately from the side seal 46, and subsequently be bonded to the side seal 46 at a predetermined position.

(Modifications)

The side seal 46 is not necessarily formed integrally with the axial direction seal member 49, and may be constituted as a member other than the axial direction seal member 49.

In addition, the image forming apparatus pertaining to the present invention is not limited to a tandem type color digital printer. The present invention is also applicable to a printer for forming a monochrome image. Furthermore, the image forming apparatus pertaining to the present invention is not limited to a printer, and also applicable to a copier, multiple function peripheral (MFP), facsimile, and the like.

INDUSTRIAL APPLICABILITY

The present invention is useful as a technology for preventing developer from sticking to a non-image-formation portion of a photoreceptor drum in a developing device that develops an electrostatic latent image on a photoreceptor by using developer.

CONCLUSION

As described above, the developing device according to the embodiments of the present invention is a developing device for forming an image by developing, using a developer, an electrostatic latent image on a photoreceptor rotating about a rotation axis, the developing device having: a housing having an opening being located opposite the photoreceptor, the opening exposing therethrough a central portion of the photoreceptor that is located at the center of the photoreceptor in a direction along the rotation axis; a developing sleeve rotatably disposed inside the housing so as to face the central portion of the photoreceptor, the developing sleeve consisting of a central portion that is located at the center of the developing sleeve and end portions that are located at both sides of the central portion in the direction along the rotation axis; a magnetic body disposed inside the central portion of the developing sleeve, the end portions of the developing sleeve that are located at both sides of the central portion being no-magnet portions; and seal members supported by the housing, the seal members each including: a shielding portion that shields, from the developer, either one of portions of the photoreceptor that are located opposite the no-magnet portions; and a contact portion that is in surface contact with either one of end portions of the photoreceptor farther from a center of the photoreceptor than the no-magnet portions in the direction along the rotation axis, wherein each of the seal members includes, at an end thereof closer to the center of the photoreceptor than the other end in the direction along the rotation axis, a non-contact portion that is not in contact with the photoreceptor.

In the above-described developing device, the non-image-formation portions of the photoreceptor that are opposite the no-magnet portions of the developing sleeve are shielded from by the seal members. Consequently, developer that has been scattered in the vicinity of the no-magnet portions of the developing sleeve sticks to the seal members. Toner also sticks to the tips of the seal members. However, the tips of the seal members are formed as non-contact portions that are not in contact with the surface of the photoreceptor drum. Accordingly, there is no risk that the developer sticking to the tips of the seal members sticks, in a stripe pattern, to the non-image-formation portion of the photoreceptor.

Preferably, each of the seal members covers a portion of the photoreceptor that is located downstream of either one of the portions of the photoreceptor opposite the no-magnet portions in a rotating direction of the photoreceptor.

Preferably, each of the seal members has a constant thickness except for the non-contact portion, and the non-contact portion has a smaller thickness than a remaining portion.

Preferably, the non-contact portion extends along the rotating direction so as not to reach a downstream end of each of the seal members in the rotating direction.

Preferably, the non-contact portion has a length along the rotating direction that is no greater than 100 times the thickness of each of the seal members.

Preferably, the non-contact portion extends along the rotating direction so as to reach a downstream end of each of the seal members in the rotating direction.

Preferably, the non-contact portion has a length along the rotating direction that is no greater than 30 times the thickness of each of the seal members.

Preferably, the non-contact portion includes a first portion having a predetermined length along the rotating direction and a predetermined length along the direction along the rotation axis, and a second portion extending downstream from one end portion of the first portion in the rotating direction, the one end portion of the first portion being located on one side of the first portion that is farther from the center of the photoreceptor than the other side of the first portion along the direction along the rotation axis, and the second portion opens at a downstream side in the rotating direction.

Preferably, one end of the first portion that is farther from the center of the photoreceptor in the direction along the rotation axis than the other end of the first portion is located farther from the center of the photoreceptor than one edge of a sheet transport area of the photoreceptor over which a recording sheet of the maximum size is transported, the one edge of the sheet transport area being an edge closer to the non-contact portion than the other edge of the sheet transport area in the direction along the rotation axis.

Preferably, the non-contact portion has a thickness that is smaller than the remaining portion by at least 50 μm.

Preferably, each of the seal members has a constant thickness except for a convex portion surrounding the non-contact portion, the convex portion protruding toward the photoreceptor.

Preferably, the convex portion has a thickness that is larger than the constant thickness by at least 50 μm.

Preferably, the convex portion is made of a different material from the portion of each of the seal members having the constant thickness.

Although the present invention has been fully described by way of examples with reference to the accompanying drawings, it is to be noted that various changes and modifications will be apparent to those skilled in the art.

Therefore, unless such changes and modifications depart from the scope of the present invention, they should be construed as being included therein.

What is claimed is:

1. A developing device for forming an image by developing, using a developer, an electrostatic latent image on a photoreceptor rotating about a rotation axis, the developing device comprising:

a housing having an opening being located opposite the photoreceptor, the opening exposing therethrough a central portion of the photoreceptor that is located at the center of the photoreceptor in a direction along the rotation axis;

a developing sleeve rotatably disposed inside the housing so as to face the central portion of the photoreceptor, the developing sleeve consisting of a central portion that is located at the center of the developing sleeve and end portions that are located at both sides of the central portion in the direction along the rotation axis;

a magnetic body disposed inside the central portion of the developing sleeve, the end portions of the developing sleeve that are located at both sides of the central portion being no-magnet portions; and seal members supported by the housing, the seal members each including:

a shielding portion that shields, from the developer, a corresponding one of surface portions of the photoreceptor that is located opposite the no-magnet portions; and a contact portion that is in surface contact with a corresponding one of end surface portions of the photoreceptor farther from the center of the photoreceptor than the no-magnet portions in the direction along the rotation axis;

wherein each of the seal members includes, at an end thereof closer to the center of the photoreceptor than the other end in the direction along the rotation axis, a non-contact portion that is not in contact with the corresponding one of the surface portions of the photoreceptor that are located opposite the no-magnet portions; and wherein the non-contact portion has a length along the rotating direction that is no greater than 100 times the thickness of each of the seal members.

2. The developing device according to claim 1, wherein each of the seal members covers a portion of the photoreceptor that is located downstream of either one of the portions of the photoreceptor opposite the no-magnet portions in a rotating direction of the photoreceptor.

3. The developing device according to claim 2, wherein each of the seal members has a constant thickness except for the non-contact portion, and the non-contact portion has a smaller thickness than a remaining portion.

4. The developing device according to claim 3, wherein the non-contact portion extends along the rotating direction so as not to reach a downstream end of each of the seal members in the rotating direction.

5. The developing device according to claim 3, wherein the non-contact portion extends along the rotating direction so as to reach a downstream end of each of the seal members in the rotating direction.

6. The developing device according to claim 5, wherein the non-contact portion has a length along the rotating direction that is no greater than 30 times the thickness of each of the seal members.

7. A developing device for forming an image by developing, using a developer, an electrostatic latent image on a photoreceptor rotating about a rotation axis, the developing device comprising:

a housing having an opening being located opposite the photoreceptor, the opening exposing therethrough a central portion of the photoreceptor that is located at the center of the photoreceptor in a direction along the rotation axis;

a developing sleeve rotatably disposed inside the housing so as to face the central portion of the photoreceptor, the developing sleeve consisting of a central portion that is located at the center of the developing sleeve and end portions that are located at both sides of the central portion in the direction along the rotation axis;

a magnetic body disposed inside the central portion of the developing sleeve, the end portions of the developing sleeve that are located at both sides of the central portion being no-magnet portions; and seal members supported by the housing, the seal members each including:

a shielding portion that shields, from the developer, a corresponding one of surface portions of the photoreceptor that is located opposite the no-magnet portions; and a contact portion that is in surface contact with a corresponding one of end surface portions of the photoreceptor farther from the center of the photoreceptor than the no-magnet portions in the direction along the rotation axis;

wherein each of the seal members includes, at an end thereof closer to the center of the photoreceptor than the other end in the direction along the rotation axis, a non-contact portion that is not in contact with the corresponding one of the surface portions of the photoreceptor that are located opposite the no-magnet portions; and wherein:

the non-contact portion includes:

a first portion having a predetermined length along the rotating direction and a predetermined length along the direction along the rotation axis; and a second portion extending downstream from one end portion of the first portion in the rotating direction, the one end portion of the first portion being located on one side of the first portion that is farther from the center of the photoreceptor than the other side of the first portion along the direction along the rotation axis, and the second portion opens at a downstream side in the rotating direction.

8. The developing device according to claim 7, wherein one end of the first portion that is farther from the center of the photoreceptor in the direction along the rotation axis than the other end of the first portion is located farther from the center of the photoreceptor than one edge of a sheet transport area of the photoreceptor over which a recording sheet of the maximum size is transported, the one edge of the sheet transport area being an edge closer to the non-contact portion than the other edge of the sheet transport area in the direction along the rotation axis.

9. A developing device for forming an image by developing, using a developer, an electrostatic latent image on a photoreceptor rotating about a rotation axis, the developing device comprising:

a housing having an opening being located opposite the photoreceptor, the opening exposing therethrough a central portion of the photoreceptor that is located at the center of the photoreceptor in a direction along the rotation axis;

a developing sleeve rotatably disposed inside the housing so as to face the central portion of the photoreceptor, the developing sleeve consisting of a central portion that is located at the center of the developing sleeve and end portions that are located at both sides of the central portion in the direction along the rotation axis;

a magnetic body disposed inside the central portion of the developing sleeve, the end portions of the developing sleeve that are located at both sides of the central portion being no-magnet portions; and seal members supported by the housing, the seal members each including:

a shielding portion that shields, from the developer, a corresponding one of surface portions of the photoreceptor that is located opposite the no-magnet portions; and a contact portion that is in surface contact with a corresponding one of end surface portions of the photoreceptor farther from the center of the photoreceptor than the no-magnet portions in the direction along the rotation axis;

wherein each of the seal members includes, at an end thereof closer to the center of the photoreceptor than the other end in the direction along the rotation axis, a non-contact portion that is not in contact with the corresponding one of the surface portions of the photoreceptor that are located opposite the no-magnet portions; and wherein the non-contact portion has a thickness that is smaller than the remaining portion by at least 50 μm.

10. The developing device according to claim 1, wherein each of the seal members has a constant thickness except for a convex portion surrounding the non-contact portion, the convex portion protruding toward the photoreceptor.

11. The developing device according to claim 10, wherein the convex portion has a thickness that is larger than the constant thickness by at least 50 μm.

12. The developing device according to claim 11, wherein the convex portion is made of a different material from the portion of each of the seal members having the constant thickness.

13. An image forming apparatus forming a toner image on a recording sheet of a size larger than a maximum-size toner image formed on the photoreceptor, and including the developing device according to claim 1.

14. The developing device according to claim 10, wherein:

the shielding portion shields, from the developer, a portion of the photoreceptor that is located opposite the no-magnet portion at a respective end of the developing sleeve;

the contact portion is in surface contact with an end portion of the photoreceptor farther from a center of the photoreceptor than the no-magnet portion at the respective end of the developing sleeve in the direction along the rotation axis; and each of the non-contact portions is at an end of the seal member thereof closer to the center of the photoreceptor than the contact portion along the rotation axis.

* * * * *